US005107548A

United States Patent [19]

Dotzenrod

[11] Patent Number: 5,107,548

[45] Date of Patent: Apr. 28, 1992

[54] COOLER CAP

[76] Inventor: Joel Dotzenrod, 15260 Co. Rd. 10, Wyndmere, N. Dak. 58081

[21] Appl. No.: 684,975

[22] Filed: Apr. 15, 1991

[51] Int. Cl.[5] ..... A42B 1/24

[52] U.S. Cl. ..... 2/209.1; 2/185 R; 2/196; 2/199; 2/DIG. 6; 220/903

[58] Field of Search ..... 2/171, 171.1, 171.2, 2/175, 185 R, 186, 195, 199, 196, 209.1, 422, DIG. 6; 220/903

[56] References Cited

U.S. PATENT DOCUMENTS

| | | | |
|---|---|---|---|
| 3,484,974 | 12/1969 | Culmone | 2/DIG. 6 |
| 4,080,665 | 3/1978 | Hodes | 2/209.1 |
| 4,268,567 | 5/1981 | Harmony | 220/903 |
| 4,282,279 | 8/1981 | Strickland | 2/DIG. 6 |
| 4,399,668 | 8/1983 | Williamson | 220/903 |
| 4,414,692 | 11/1983 | Dzierson | 2/DIG. 6 |
| 4,451,935 | 6/1984 | Henschel | 2/185 R |
| 4,540,611 | 9/1985 | Henderson | 220/85 |
| 4,611,355 | 9/1986 | Galanto | 2/199 |
| 4,671,424 | 6/1987 | Byrns | 220/903 |
| 4,768,232 | 9/1988 | Villalobos | 2/196 |
| 4,776,043 | 10/1988 | Coleman | 2/185 R |
| 4,873,726 | 10/1989 | Tapia | 2/195 |
| 4,896,378 | 1/1990 | Campana | 2/DIG. 6 |

*Primary Examiner*—Werner H. Schroeder
*Assistant Examiner*—Diana L. Biefeld
*Attorney, Agent, or Firm*—Jacobson and Johnson

[57] ABSTRACT

The present invention comprises a combination can holder and cap that includes fastening members on the cap that permit the user to attach or detach a flat rectangular shaped can holder to the cap so that the can holder can be carried with the user in an out of the way location. When the user needs the can holder the user merely removes the can holder from the cap then places the can holder around the canned drink to keep the drink from rapidly warming up.

11 Claims, 2 Drawing Sheets

COOLER CAP

FIELD OF THE INVENTION

The present invention generally relates to a system for a user to carry a can cooler or can holder on the person at all times, and more specifically a combination of a headgear and a wrap-around can holder that permits the user to store the insulated can holder on the headgear when the can holder is not in use.

BACKGROUND OF THE INVENTION

One of the simpler but more useful items for keeping a canned drink cool consists of a rectangular shaped insulating material that a user wraps around the outside of a canned drink to retard the flow of heat into the canned drink. A reusable attaching member located along the ends of the material permits the user to fasten the ends of the insulating material around the can and to each other to form a cylindrical holder that retards heat flow through the insulating material. One of the problems with the can holders is that the insulating material is bulky making it difficult for the user to carry the can holder from place to place. Generally the insulating material is too large and bulky to fit comfortably in a user's pocket. The present invention provides a combination cap and can holder that permits a user to carry the can holder in an out of the way location. I have discovered that since the can holder is light weight a user can attach a can holder to a cap and wear the cap with the can holder without causing any wearer discomfort. Should the wearer of the combination cap and can holder need the can holder to hold a chilled drink the user simply removes the can holder from the cap and places it around the canned drink. Once the drink is finished the user removes the can holder from around the canned drink and places it back on the cap for future use.

BRIEF SUMMARY OF THE INVENTION

Briefly, the present invention comprises a combination can holder and headwear such as a cap that includes fastening members on the cap that permit the user to attach or detach a flat rectangular shaped can holder thereto so that the can holder can be carried with the user in an out of the way location. When the user needs the can holder the user merely removes the can holder from the cap and then places the can holder around the canned drink to keep the drink from rapidly warming up.

DESCRIPTION OF THE PRIOR ART

U.S. Pat. No. 4,768,232 shows a combination baseball hat and baseball glove to allow a person to use the hat to catch a baseball. The cap allows a fan attending a baseball game to use his hat and protect his or her hand when they attempt to catch a ball hit into the stands.

U.S. Pat. No. Des. ',513,336 shows a visor cap with a panel on the front.

U.S. Pat. No. 4,080,665 shows a tennis racket cover that converts to a cap for user to wear while playing tennis.

U.S. Pat. No. 4,268,567 shows a can holder for canned drinks that a user wraps around the canned drink to provide insulation between the hand and the can.

U.S. Pat. No. 4,282,279 shows a further embodiment of an insulated enclosure that can be wrapped around a can.

U.S. Pat. No. 4,451,935 shows a cap with a side pocket for holding small articles.

U.S. Pat. No. 4,540,611 shows a fold-up one-piece beverage insulator can which is collapsible for storage.

U.S. Pat. No. 4,611,355 shows a cap with Velcro-type material on its front portion and interchangeable patches for attaching to the front of the cap.

U.S. Pat. No. 4,776,043 shows a similar cap with a permanent slogan on the front of the cap and a Velcro-type material for receiving an patch containing the names of athletic team.

DESCRIPTION OF THE PREFERRED EMBODIMENT

Generally my invention comprises a combination headwear such as a cap or hat having means on the cap to permit attachment and removal of a wrap around can holder.

Figure 1:
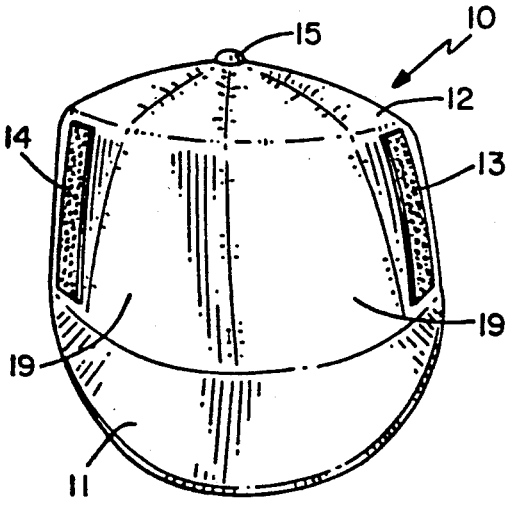
FIG. 1 shows a cap for holding a can holder.

Referring to FIG. 1, reference numeral 10 identifies my invention. Reference numeral generally 12 identifies a cap having a plurality of gore panels 19 terminating at button 15. A brim or visor 11 extends along the bottom of cap 12. Located on the front surface portion of a first gore panel 19 is a first elongated strip of material 14 for attaching and detaching an object thereto. Located on the front portion of another gore panel 19 is a second elongated strip of material 13 for attaching and detaching an object thereto. Strips 13 and 14 are spaced from each other with the strips located in a general parallel relationship to each other. Strips 13 and 14 may be Velcro or Velcro like material with a plurality of loop like members extending outward from the strips to engage hook like members extending outward from another strip.

Figure 3:
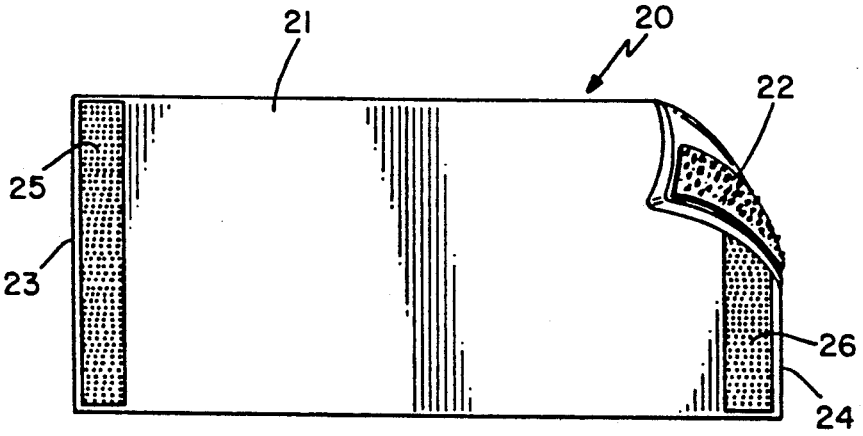
FIG. 3 shows a can holder in the open position.
Figure 4:
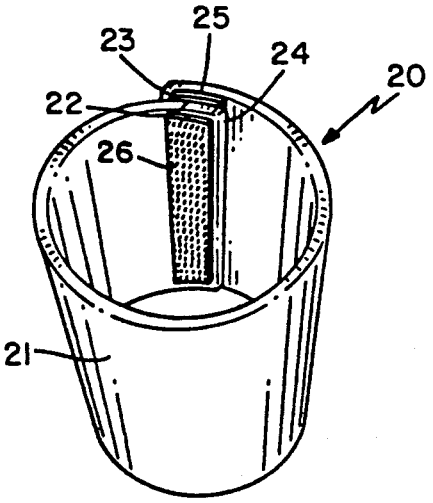
FIG. 4 shows the can holder fastened to itself to provide an insulated can holder for a canned drink.

Referring to FIG. 3, reference numeral 20 identifies a wraparound, insulated can holder for holding a beverage can. Reference numeral 21 identifies a two faced rectangular strip of insulating material with a strip of hook material 25 on one end 23 and a similar strip of hook material 26 on the opposite end 24 but on the same face. Located on the opposite face is a third strip of loop material 22. FIG. 4 shows the insulating can holder 20 in a closed position for holding a beverage can therein. In the beverage can holding position loop strip 22 engages a hook strip 25 to form a cylindrical container around the exterior surface of a can or the like. Typically material 22 comprises a flexible, lightweight material that can be smoothly wrapped around a cylindrical container. A suitable material for can holder 20 may be a sheet made of flexible and deformable polyproplene or the like.

When the insulated can holder 20 is in the open position as shown in FIG. 3, the user can fasten the insulated can holder to the crown or front portion portion of cap 12 through the use of strips 25 and 26 on the face of can holder 20. That is, attachment strips 25 and 26 located on the ends of insulating materiel 21 are spaced sufficiently far apart so that they mate with the attachment members 13 and 14 on cap 12 when the can holder is in an extended position. With the insulated can holder in an extended position the user can temporarily secure the can holder to the attachment members 13 and 14 located on the front portion of cap 10.

Figure 2:
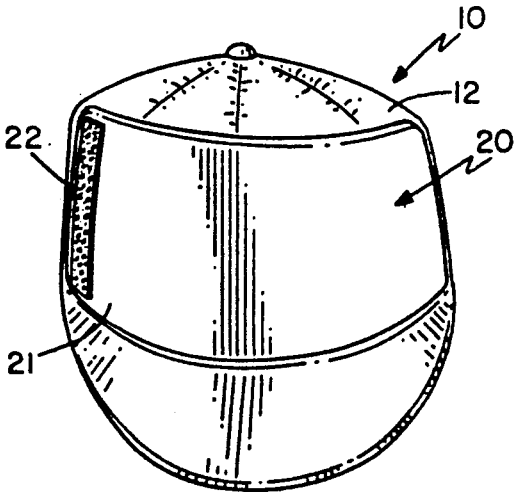
FIG. 2 shows the cap of FIG. 1 with a can holder attached thereto.

FIG. 2 shows can holder 20 secured to the front of cap 10. This combination of cap and can holder allows the user to carry around the can holder so it is ready for use. In the embodiment of FIGS. 1 to 4 the can holder includes an extra strip of attachment material 26 so the can holder can be mounted on outward facing strips on the front gore panels of cap 10.

FIG. 5 to 8 shows an alternate embodiment of the invention 40 where one of the attachment members on the cap has a U-shape to permit attachment of a can holder without any additional attachment members on the can holder.

Figure 5:
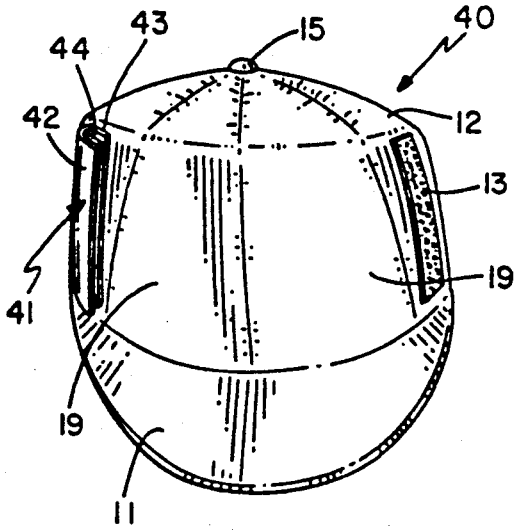
FIG. 5 shows an alternate embodiment of a cap for holding a can holder.

The invention of FIGS. 5 through 8 is identical to the invention of FIG. 1 except one of the means for attaching the insulated can holder to the cap faces inward rather than outward. That is, FIG. 5 shows a combination 40 with cap 12 having a U-shaped strip 41 having an outer side 42 with an inward facing attachment strip 44 and an inner section 43 attached to gore panel 19 through means such as stitching or adhesives. Located on the other side of cap 12 is a strip of attachment material 13 that is identical to the strip of attachment material 13 on cap 12 shown in FIG. 1. In the embodiment of FIGS. 5 through 8 one of the attachment members can be considered a male member and the other can be considered a female member. That is, to attach the two members together a male member such as the hook like extensions can be engaged to a female member with loop like extensions.

Figure 7:
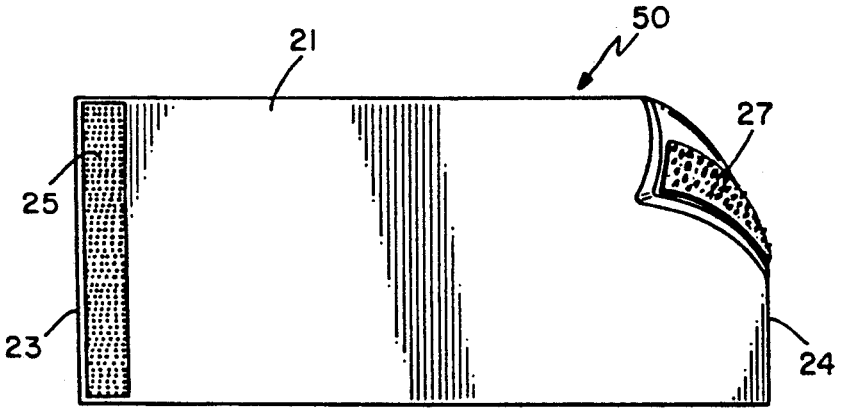
FIG. 7 shows an alternate embodiment of a can holder in the open position.

FIG. 7 illustrates the insulated can holder 50 for use in attachment to the cap 12 in FIG. 5. The insulated can holder 50 contains an elongated hook strip 25 on one end 23 and an elongated loop strip 27 on the opposite end 24.

Figure 8:
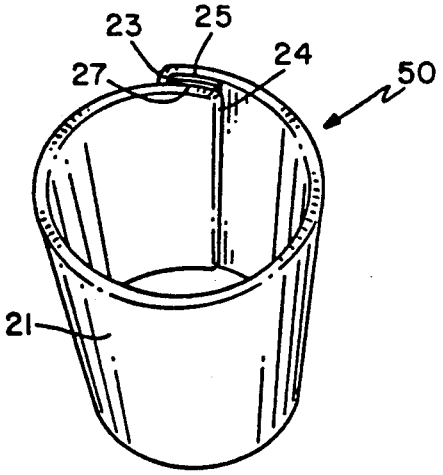
FIG. 8 shows the can holder of FIG. 7 fastened to itself to provide an insulated can holder for a canned drink.

FIG. 8 illustrates how the insulated can holder 50 appears when wrapped around a can (not shown) to insulate a can in the user's hand.

Figure 6:
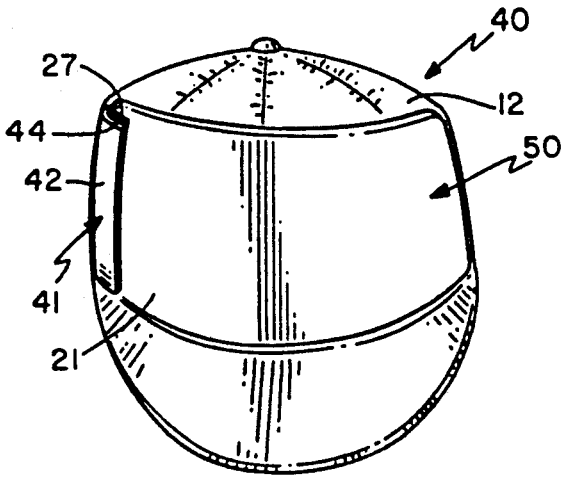
FIG. 6 shows the cap of FIG. 5 with a can holder attached thereto.

FIG. 6 shows the insulated can holder 50 fastened to cap 12. It also illustrates that one end of insulating strip 21 having strip 25 is fastened on the inside facing attachment 44 located on member of the U-shaped material 41 to hold one end of insulated can holder 50 against the crown or front of cap 12. The strip of attaching material 27 on the opposite end engages strip 13 to hold the insulated can holder on the front portion of cap 12. Thus, in the embodiment of FIGS. 5 through 8, the use of a U-shaped strip attachment permits use of my cap with a conventional insulated can holder having male and female attachment members. That is the male and female attachment members of the can holder 21 can be used to engage the male and female attachment members on cap 12.

If desired the can holder can include an advertisement slogan on its face that is visible when the can holder is used as a can holder and when the can holder is carried about on the user cap.

I claim:

1. A headwear can holder combination comprising:

a headwear member for wearing on a persons head, said headwear member having a surface, said surface having means for attaching a can holder thereto;

a can holder, said can holder comprising a general rectangular shaped insulating material having a first end and a second end, said first end of said can holder including a first fastening member, said second end of said can holder including a second fastening member for attaching to said first fastening member to permit said can holder to be fastened around a can, said first fastening member and said second fastening member being removably attached to said means for attaching a can holder thereto to permit a user to carry the can holder on the headwear so that when the user needs a can holder the user can remove the can holder from the headwear and wrap the can holder around a can and when the user is done using the can holder the user can reattach the can holder to the headwear so that the can holder is ready for future use.

2. The headwear can holder combination of claim 1 wherein said means for attaching a can holder thereto includes a first attachment member and a second attachment member with said first attachment member spaced from said second attachment member.

3. The headwear can holder combination of claim 2 wherein said first attachment member and said second attachment member are spaced from each other sufficiently far so that said when said first attachment member engages said first fastening member of said can holder and said second attachment member engages said second fastening member it holds said can holder in an open condition conforming to a curvature of the headwear.

4. The headwear can holder combination of claim 3 wherein said first attachment member, said second attachment member, said first fastening member and said second fastening member comprise a Velcro type hook and loop material for removably attaching said can holder to said headwear.

5. The headwear can holder combination of claim 4 wherein said can holder contains a permanent marking thereon that is viewable when the can holder is mounted to said headwear.

6. The headwear can holder combination of claim 2 wherein said first attachment member comprises a U-shaped member that faces inward toward the user's head and said second attachment member faces outwardly away from the user's head.

7. The headwear can holder combination of claim 2 wherein said headwear comprises a cap having a top with gore panels terminating in a button on the top of the cap.

8. The headwear can holder combination of claim 7 wherein said cap includes a brim with said can holder mounted to said cap proximate said brim of said cap.

9. The headwear can holder combination of claim 8 wherein said cap has a front portion and a back portion with said can holder mounted on said front portion of said cap.

10. The headwear can holder combination of claim 9 wherein said can holder comprises a sheet of flexible foam for wrapping around a canned drink.

11. The headwear can holder combination of claim 1 wherein said headwear includes a male and female attachment member for mating with male and female members on said can holder.

* * * * *